US008771105B2

(12) United States Patent
MacKeen

(10) Patent No.: US 8,771,105 B2
(45) Date of Patent: Jul. 8, 2014

(54) GOLF TEE WITH LOW ENERGY ABSORPTION

(76) Inventor: Gregory Ransom Ward MacKeen, Toronto (CA)

( * ) Notice: Subject to any disclaimer, the term of this patent is extended or adjusted under 35 U.S.C. 154(b) by 46 days.

(21) Appl. No.: 13/181,979

(22) Filed: Jul. 13, 2011

(65) Prior Publication Data

US 2012/0028734 A1 Feb. 2, 2012

Related U.S. Application Data

(60) Provisional application No. 61/368,580, filed on Jul. 28, 2010.

(51) Int. Cl.
*A63B 57/00* (2006.01)

(52) U.S. Cl.
USPC ..... 473/387; 473/401

(58) Field of Classification Search
USPC ..... 473/387, 399, 401
See application file for complete search history.

(56) References Cited

U.S. PATENT DOCUMENTS

| | | | | | |
|---|---|---|---|---|---|
| D54,236 | S | | 12/1919 | Brewster | |
| 1,573,911 | A | | 12/1925 | Budrow | |
| 4,126,438 | A | * | 11/1978 | Pulli et al. | 504/101 |
| 5,042,806 | A | * | 8/1991 | Helmstetter | 473/311 |
| 5,154,417 | A | * | 10/1992 | Kohli | 473/401 |
| 5,275,406 | A | * | 1/1994 | Smagula | 473/146 |
| 5,505,444 | A | | 4/1996 | Boucli | |
| 6,110,059 | A | * | 8/2000 | Haggarty | 473/387 |
| 6,290,616 | B1 | * | 9/2001 | Evans et al. | 473/399 |
| D492,973 | S | | 7/2004 | Madore | |
| D502,972 | S | | 3/2005 | DeLisle | |
| D565,126 | S | | 3/2008 | Fong et al. | |
| D586,411 | S | | 2/2009 | Iacono | |
| D603,005 | S | | 10/2009 | Steinhobel | |
| 2002/0198066 | A1 | | 12/2002 | Salsman | |
| 2004/0067802 | A1 | | 4/2004 | Salsman | |
| 2008/0182684 | A1 | * | 7/2008 | Carroll et al. | 473/398 |
| 2009/0275426 | A1 | | 11/2009 | DeLisle | |
| 2010/0022695 | A1 | * | 1/2010 | Patel | 524/438 |

* cited by examiner

*Primary Examiner* — Vishu K. Mendiratta
(74) *Attorney, Agent, or Firm* — Michael S. Neustel

(57) ABSTRACT

A golf tee may be constructed with a body formed from a polymer tolerant of exposure to a temperature at least as high as 480° F. without incurring diminishment of its structural integrity. A low-friction coating may be applied to a ball support of the tee.

4 Claims, 2 Drawing Sheets

GOLF TEE WITH LOW ENERGY ABSORPTION

RELATED APPLICATIONS

This application claims the benefit of U.S. Provisional Patent Application No. 61/368,580 filed on Jul. 28, 2010

BACKGROUND OF THE INVENTION

The present invention generally relates to a golf tee which may support a golf ball with minimal frictional interaction between the ball and the tee.

When a golf ball is struck by a golf club from atop a golf tee, frictional forces between the tee and the ball reduce the transfer of energy from the club to the ball, reducing the distance the ball travels.

There is a need for a golf tee which may support a golf ball so that there may be only a minimal reduction of transfer of energy from a club to the ball.

SUMMARY OF THE INVENTION

In one aspect of the present invention, a golf tee may comprise a body formed from a polymer tolerant of exposure to a temperature at least as high as about 500° F. without incurring diminishment of its structural integrity; and a low-friction coating applied to a ball support of the tee.

In another aspect of the present invention, a golf tee may comprise a cup-shaped ball support with an inner radius smaller than a radius of a golf ball; and a plurality of cusps positioned on an outer periphery of the support.

In still another aspect of the invention, a method for producing golf tees may comprise the steps of injection molding a body of the tee; wet-coating a ball support portion of the body with a solution of polytetrafluoroethylene and solvent; and placing the wet-coated body in a heated chamber to raise the temperature of the body to about 500° F. and fuse the PTFE onto the body.

These and other features, aspects and advantages of the present invention will become better understood with reference to the following drawings, description and claims.

DETAILED DESCRIPTION OF THE INVENTION

Figure 1:
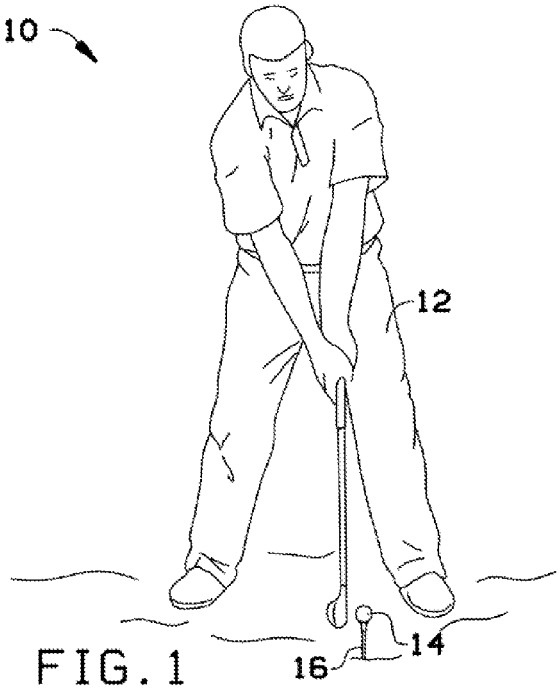
FIG. 1 is a perspective view of a golfer using a tee constructed in accordance with an embodiment of the invention.
Figure 2:
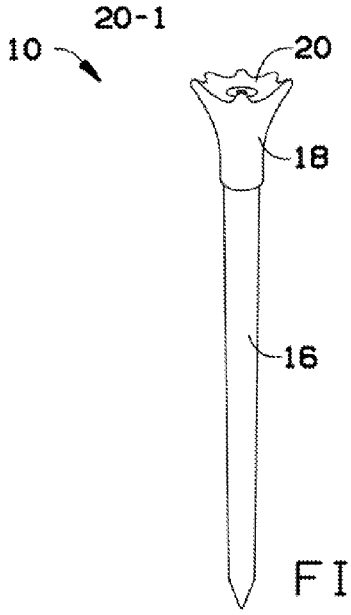
FIG. 2 is a perspective view of the tee of FIG. 1.
Figure 3:
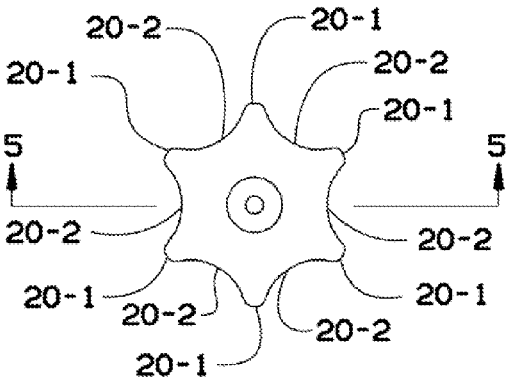
FIG. 3 is a top view of the tee of FIG. 2.
Figure 4:
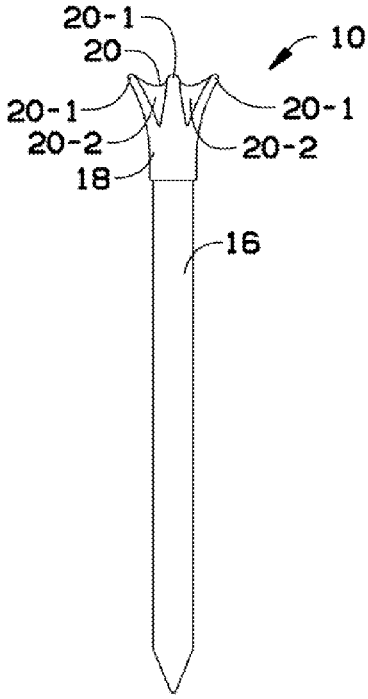
FIG. 4 is an elevation view of the tee of FIG. 2.
Figure 5:
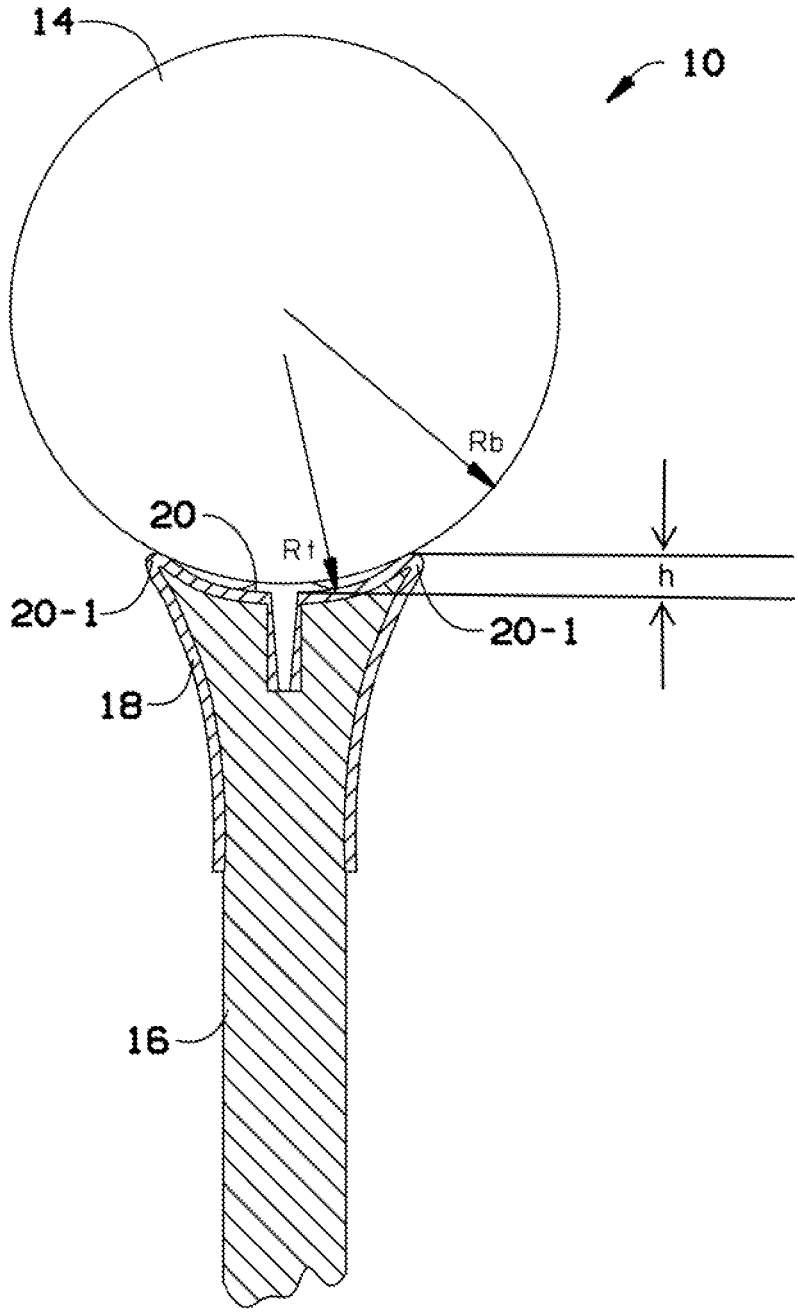
FIG. 5 is a cross sectional view of the tee of FIG. 3 taken along the lines 5-5 illustrating a golf ball in position on the tee.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide reduction of the negative impact on the transfer of energy from the golf club to the ball caused by the frictional forces between a tee and a ball. More particularly such reduction may be achieved by configuring a ball support component of the tee so that there is minimal surface area in contact with the ball and also by coating surface of the ball support component of the tee with a low friction material.

Referring now to the Figures, it may be seen that an exemplary embodiment of a golf tee 10 may comprise a tee body 16 and a coating 18. A ball support 20 may be provided at one end of the body 16. The ball support 20 may be cup-shaped with an inner radius Rt of the tee that is smaller than an outer radius Rb of a golf ball 14, In a particularly advantageous exemplary embodiment, the bail support 20 may be configured with a plurality (e.g. six or more) of cusps 20-1 positioned on an outer periphery of the support 20. The cusps 20-1 may have a median width of about 0.025 inch to about 0.050 inch and a height h of about 0.04 inch. The cusps 20-1 may be interconnected with segments 20-2 of the support 20. These interconnection segments 20-2 may be shaped with the radius Rt. Consequently, a surface of the ball 14 may not contact the segments 20-2. In other words, the ball 14 may be supported solely on the cusps 20-1.

It may be noted that the exemplary tee 10 may employ a large number of small points of contact. Collectively the surface area of the cusps 20-1 may be less than the ball-contact surface area of conventional tees. However, because of the large number of cusps 20-1, a golfer may balance a ball on the tee 10 with the same ease as that experienced with a conventional tee.

In an exemplary embodiment, the coating 18 may comprise low-friction material such as polytetrafluoroethylene (PTFE) or similar low friction polymer such as fluorinated ethylene-propylene, ethylene/tetrafluoroethylene and other fluorine/polymers. The coating 18 may have a thickness of about 0.005 inch to about 0.010 inch. The body 16 may comprise a high-temperature tolerant polymer such as nylon (e.g., nylon 6 or nylon 6.6). Advantageously, the polymer may be mixed with glass fibers to increase its melting point and to improve its structural integrity.

The tee 10 may be produced in a series of steps that may include mixing glass fibers with nylon resin and injection molding the body 16 with the mixture. An end of the injection-molded body 16 may be dipped into a solution of PTFE and solvent to wet-coat the end of the body 16. The wet-coated body 16 may then be placed in a heated chamber and raised to a temperature of about 480 to 500° F., at which temperature solvent may be driven from the PTFE solution and the PTFE may fuse onto the polymer of the body 16. Alternatively, the coating may be applied to the body 16 by spraying the body 16 with PTFE solution or by applying a film of PTFE and then heat curing the PTFE.

It may be noted that the body 16 may be exposed to temperatures of about 480 to 500° F. or higher during curing and fusing of the PTFE coating 18. Consequently, the body material must be tolerant of exposure to such temperatures without experiencing latent diminishment of structural strength. If the body 16 were made of wood, for example, a PTFE coated tee could emerge from the manufacturing process and have the appearance of being a workable golf tee. However, such a tee may have incurred impairment of its structural strength during exposure to high temperature. Such a structurally impaired tee may break after a single use by a golfer. Similarly, if the body 16 were made of other commonly used tee making materials, such as ABS (Acrylonitrite Butadiene Styrene), or PLA (Polylactic Acid), or PP (Polypropylene), the body would start to melt and thus distort its shape, since the melting points of all these materials is below a 482° F. curing or fusing temperature of PTFE. The tee 10, on the other hand, may retain structural integrity even after being exposed to PTFE fusing temperature. Consequently, the tee 10 may not break even after repeated uses.

It should be understood, of course, that the foregoing relates to exemplary embodiments of the invention and that modifications may be made without departing from the spirit and scope of the invention as set forth in the following claims.

What is claimed is:

1. A golf tee, comprising:

a tee body having a lower end and an upper end, wherein said upper end is comprised of a ball support;

wherein said ball support is comprised of at least six cusps positioned on an outer periphery of said ball support and extending upwardly, wherein said at least six cusps have a median width of about 0.025 inch to about 0.050 inch and a height of about 0.04 inch;

wherein said tee body is comprised of a polymer-fiber composition having a polymer mixed with glass fibers, wherein said polymer-fiber composition is tolerant of exposure to a temperature of at least 480° F. without melting or incurring diminishment of its structural integrity; and a fluorine/polymer coating applied to said ball support, said fluorine/polymer coating further comprised of polytetrafluoroethylene, wherein said coating is fused to said ball support at a temperature of at least 480° F. and wherein said coating has a thickness of between 0.005 inch to 0.010 inch.

2. The golf tee of claim 1, wherein said coating is applied to at least an upper surface of said ball support.

3. The golf tee of claim 2, wherein said coating is applied to a side portion of said ball support.

4. The golf tee of claim 1, wherein said polymer is comprised of nylon.

* * * * *